US006722235B2

(12) United States Patent
Hsieh

(10) Patent No.: US 6,722,235 B2
(45) Date of Patent: Apr. 20, 2004

(54) TORQUE WRENCH WITH A SCALE

(76) Inventor: Chih-Ching Hsieh, No. 367, Peiyang Rd., Fengyuan City, Taichung Hsien (TW)

( * ) Notice: Subject to any disclaimer, the term of this patent is extended or adjusted under 35 U.S.C. 154(b) by 123 days.

(21) Appl. No.: 10/083,767

(22) Filed: Feb. 25, 2002

(65) Prior Publication Data

US 2003/0159552 A1 Aug. 28, 2003

(51) Int. Cl.[7] ..... B25B 23/142
(52) U.S. Cl. ..... 81/478; 81/483
(58) Field of Search ..... 81/478, 467, 468, 81/472, 473, 475, 477, 483, DIG. 5

(56) References Cited

U.S. PATENT DOCUMENTS 2,300,652 A * 11/1942 Cooney ..... 81/483
3,577,815 A * 5/1971 Bergquist ..... 81/483
3,742,786 A * 7/1973 Krain ..... 81/483
4,290,329 A * 9/1981 Green ..... 81/477
4,870,879 A * 10/1989 Shieh ..... 81/483
4,898,068 A * 2/1990 Neuhaus ..... 81/483
5,605,081 A * 2/1997 Chen et al. ..... 81/467
5,859,371 A * 1/1999 Hsieh ..... 73/862.23

FOREIGN PATENT DOCUMENTS

JP 2000280184 A * 10/2000 ..... B25B/23/142

* cited by examiner

*Primary Examiner*—Joseph J. Hail, III
*Assistant Examiner*—David B. Thomas
(74) *Attorney, Agent, or Firm*—Alan Kamrath

(57) ABSTRACT

A torque wrench has a shank, an arm, a torque-adjusting device, a handle and an adjusting knob. The handle is mounted around one end of the shank and has a mouth. A window is defined in the periphery of the mouth. The adjusting knob is rotatably attached to the shank. A stepped protrusion formed on the adjusting knob is connected to the torque-adjusting device and is received in the mouth. A scale is formed on the outer periphery of the stepped protrusion and corresponds to the window. An index line is formed on the handle and corresponds to the scale. Accordingly, the scale can be easily read through the window with the index line. The mouth can provide a protecting effect to the scale to keep the scale from being worn off, such that the useful life of the torque wrench is prolonged.

10 Claims, 6 Drawing Sheets

TORQUE WRENCH WITH A SCALE

BACKGROUND OF THE INVENTION

1. Field of the Invention

The present invention relates to a torque wrench, and more particularly to a torque wrench with an easy-read scale.

2. Description of Related Art

To provide a precise tightening to a fastener, a torque wrench is used to tighten the fastener to secure two objects together with a desired torque. An adjusting knob is mounted on the torque wrench to adjust the torque that the wrench applies to the fastener. To show the amount of torque to the user, a scale is mounted around the outer periphery of the adjusting knob, and a pointer is mounted on the shank of the wrench to point out the number on the scale. Consequently, the user can read the torque provided by the wrench from the pointed number on the scale.

However, as the scale of the conventional torque wrench is exposed on the outer periphery of the adjusting knob, the scale is easily worn off when the user rotates the adjusting knob. The scale will lose its indicating function after a long time of use.

To overcome the shortcomings, the present invention tends to provide a torque wrench to mitigate or obviate the aforementioned problems.

SUMMARY OF THE INVENTION

The main objective of the invention is to provide a torque wrench with an easy-read scale. The torque wrench has a shank, an arm, a torque-adjusting device, a handle and an adjusting knob. The handle is mounted around one end of the shank and has a mouth formed on one end of the handle. A window is defined in the periphery of the mouth. The adjusting knob is rotatably attached to the shank. A stepped protrusion is formed on the adjusting knob. The stepped protrusion is connected to the torque-adjusting device and is received in the mouth. A scale is formed on the outer periphery of the stepped protrusion and corresponds to the window on the handle. An index line is formed on the handle and corresponds to the scale on the adjusting knob. The scale can be easily read through the window with the index line. Because the scale is received in the mouth on the handle, the scale will not be worn off even after a long time of use, and the useful life of the torque wrench is prolonged.

Other objects, advantages and novel features of the invention will become more apparent from the following detailed description when taken in conjunction with the accompanying drawings.

DETAILED DESCRIPTION OF PREFERRED EMBODIMENT

Figure 1:
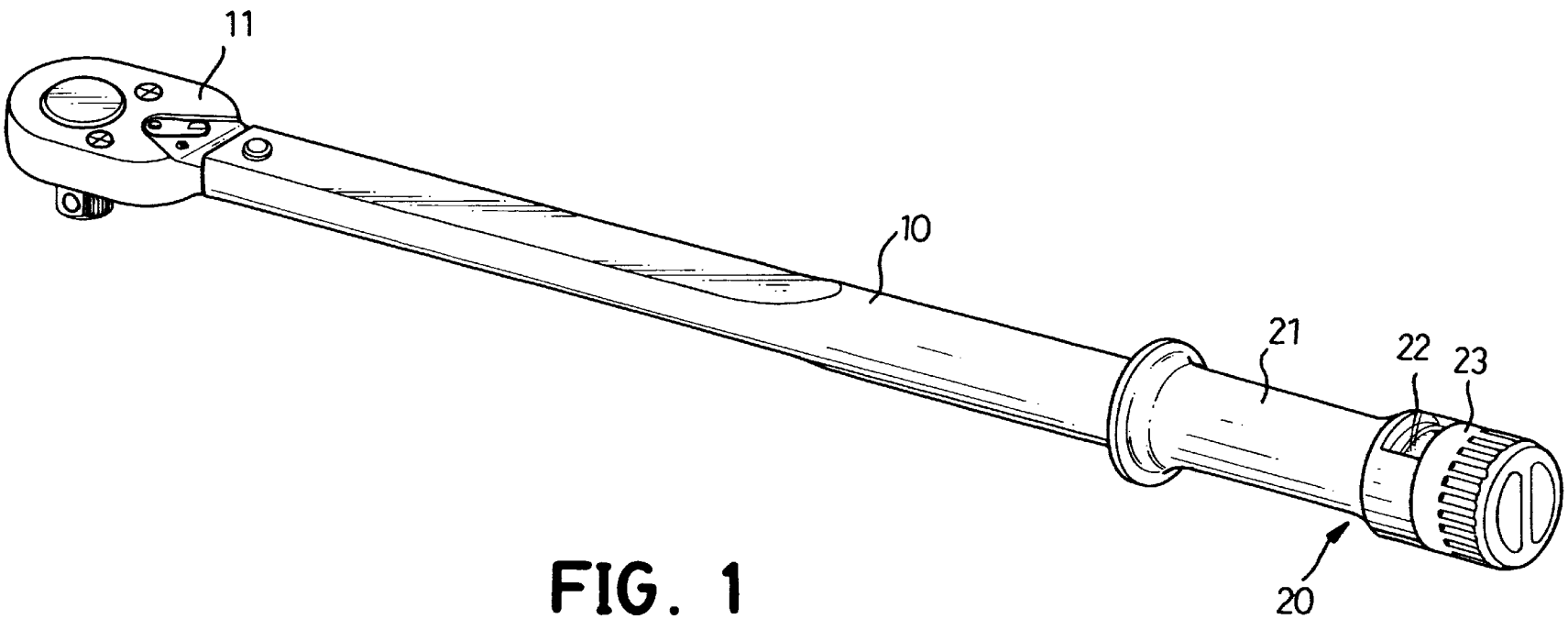
FIG. 1 is a perspective view of a torque wrench in accordance with the present invention.
Figure 2:
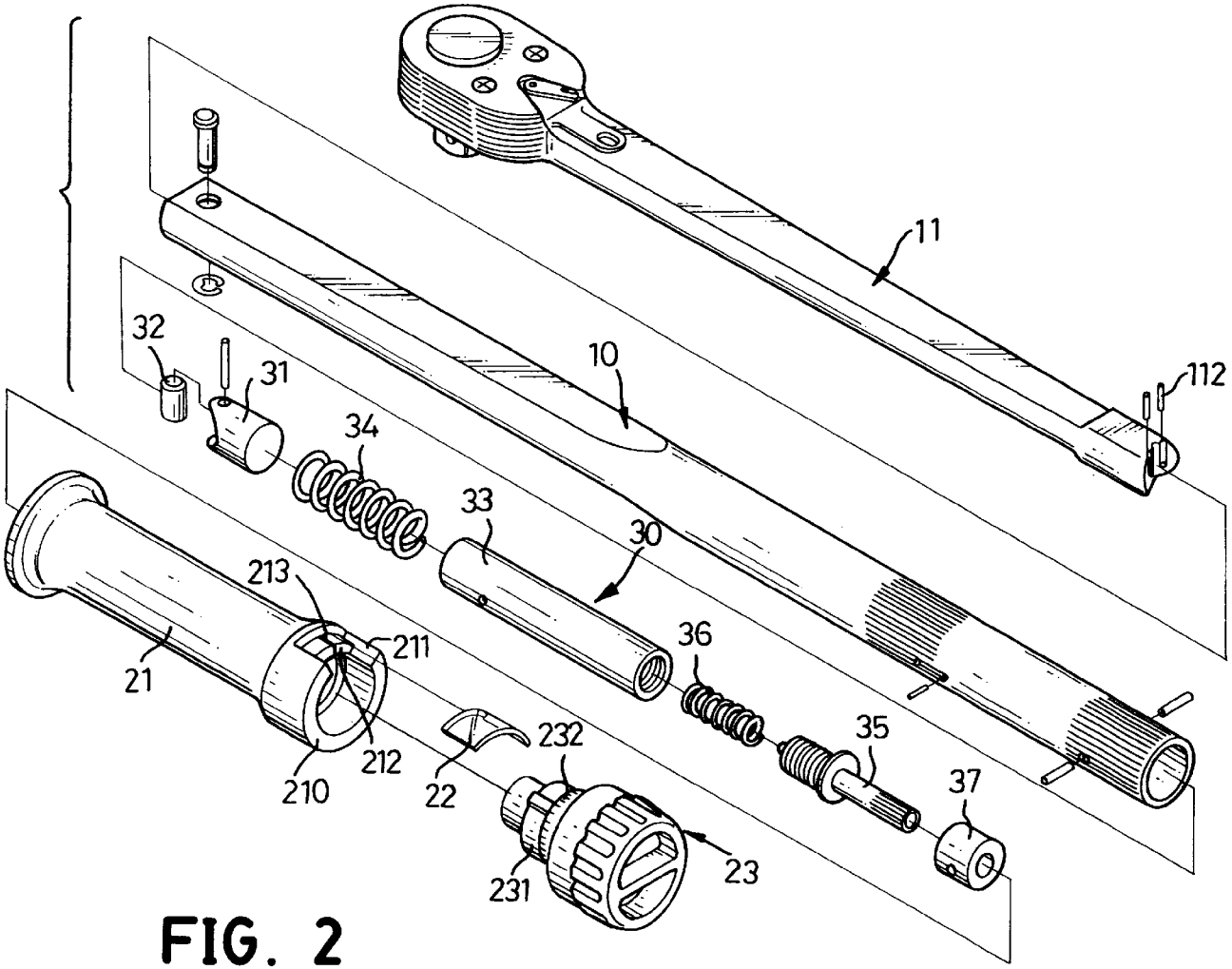
FIG. 2 is an exploded perspective view of the torque wrench in FIG. 1.

With reference to FIGS. 1 and 2, a torque wrench in accordance with the present invention comprises a shank (10), an arm (11), a torque-adjusting device (30), an adjusting knob (23) and a handle (21). The shank (10) is a tubular member and has a first end and a second end. The arm (11) is inserted into the first end of the shank (10). An engaging portion is mounted at the exposed end of the arm (11) to fit with specific sleeves that are used to rotate desired fasteners.

The torque-adjusting device (30) is mounted in the shank (10) and is connected to the arm (11). The torque-adjusting device (30) comprises a cylinder (32), a cylinder mount (31), a pushing sleeve (33), two biasing members (34,36), a pushing bar (35) and a collar (37). The cylinder (32) is attached to the cylinder mount (31) with a pivot (not numbered) and abuts the end of the arm (11) at a position between two pins (112). The first biasing member (34) is mounted between the cylinder mount (31) and the pushing sleeve (33) to provide a pushing force to the cylinder mount (31) to press against the arm (11) through the cylinder (32). Accordingly, the arm (11) will not rotate relative to the shank (10) by means of the pressing force provided by the first biasing member (34) through the cylinder mount (31) and the cylinder (32) when the wrench is in operation.

When the torque provided to the fastener by the arm (11) is over a desired level, one of the pins (112) will pass over the cylinder (32) and the arm (11) will rotate relative to the shank (10) whereby a sound will be made when the end of the arm (11) bumps against the inner surface of the shank (10). This can control the torque provided by the wrench to the fastener in a desired range.

The second biasing member (36) is received in the pushing sleeve (33) and has an end abutting the inner surface of the pushing sleeve (33). The pushing bar (35) is screwed into the pushing sleeve (33) at an end far from the cylinder mount (31). The other end of the second biasing member (36) abuts the inserted end of the pushing bar (35). The collar (37) is securely received in the shank (10) and is mounted around the exposed end of the pushing bar (35), such that the pushing bar (35) can rotate relative to the collar (37).

The adjusting knob (23) is rotatably attached to the second end of the shank (10). A stepped protrusion (231) is formed on the adjusting knob (23) and is securely connected to the pushing bar (35) of the torque-adjusting device (30). Consequently, when the adjusting knob (23) is rotated, the pushing bar (35) is rotated with the adjusting bar (23). The pushing sleeve (33) will move relative to the shank due to the threaded engagement between the sleeve (33) and the pushing bar (35), such that the first biasing member (34) wilt be compressed or stretched. Accordingly, the force provided to the cylinder mount (31) by the first biasing member (34) is changed, so that the torque provided by the wrench is also adjusted. In addition, a scale (232) is formed on the outer periphery of the stepped protrusion (231) to show the corresponding torque force applied to the fastener.

The handle (21) is mounted around the second end of the shank (10) and is made of a flexible material such as a rubber material, silicone or the like. A mouth (210) is formed on one end of the handle (21) and surrounds the stepped protrusion (231) of the adjusting knob (23). A notch (211) is defined in the periphery of the mouth (210) on the handle (21) and corresponds to the scale (232) on the stepped protrusion (231). An extension (212) extends from the bottom of the notch (211) in a length shorter than the depth of the notch (211), such that a window (not numbered) is defined in the second end of the handle (21) for the scale (232) on the stepped protrusion (231) to be shown from the window. An index line (213) is formed on the top of the extension (212) and corresponds to the scale (232) on the stepped protrusion (231). Accordingly, the scale (232) can be easily read through the window with the index line (213). Because the scale (232) is formed on the stepped protrusion (231) received in the mouth (210) on the handle (21), the fingers of the user will not touch the scale (232) when the user rotates the adjusting knob (23). Therefore, the scale (232) will not be worn off, and the useful life of the torque wrench is prolonged.

In addition, a magnifier (22) is secured in the notch (211) to cover the window, such that the scale (232) can be clearly shown by means of the magnifying effect provided by the magnifier (22).

Figure 3:
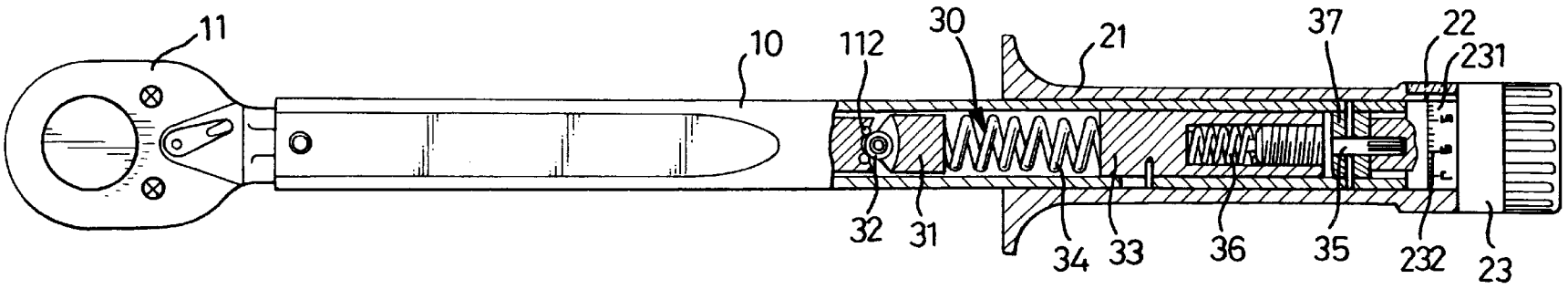
FIG. 3 is a top plan view in partial cross section of the torque wrench in FIG. 1.
Figure 4:
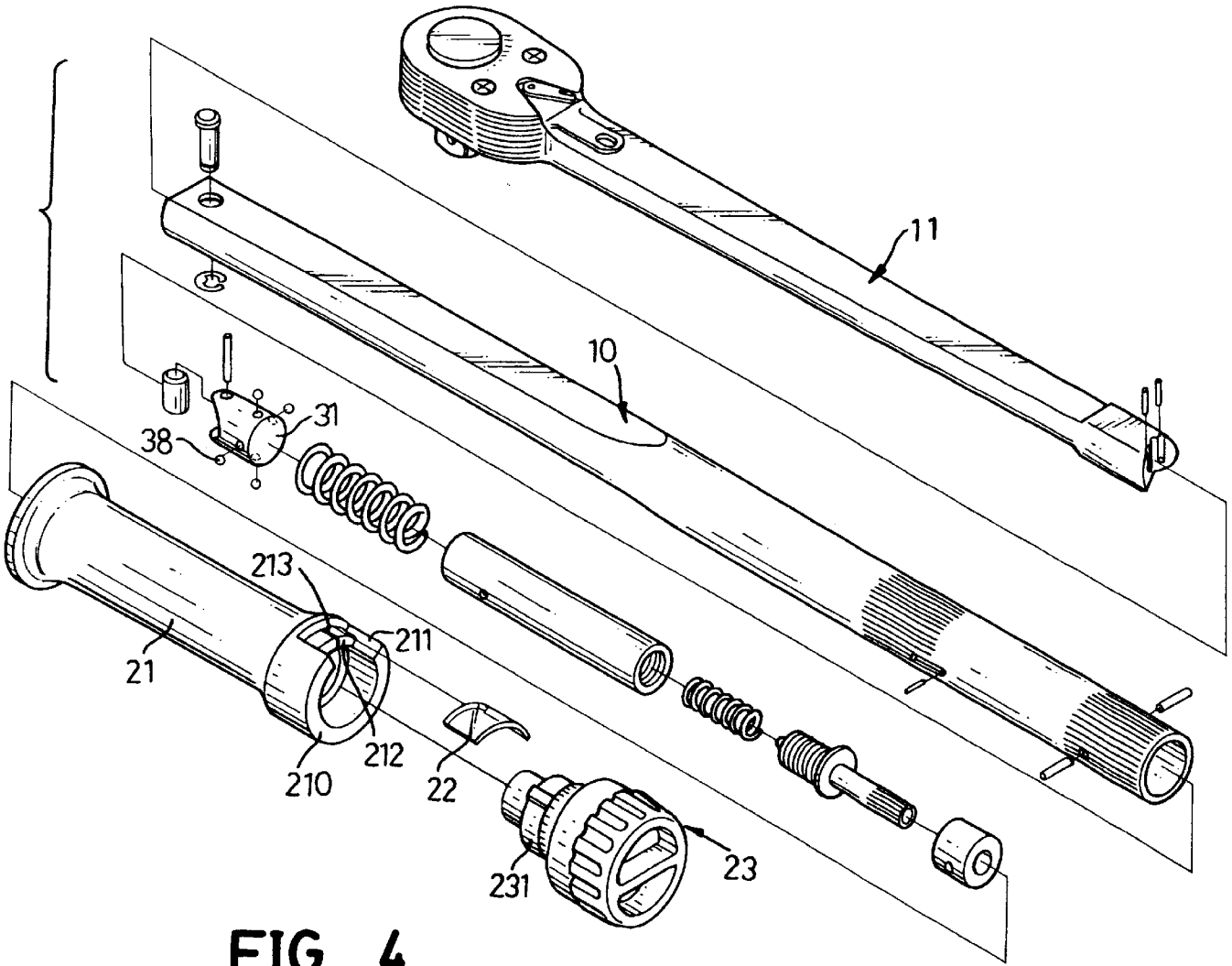
FIG. 4 is an exploded perspective view of a second embodiment of a torque wrench in accordance with the present invention.
Figure 5:
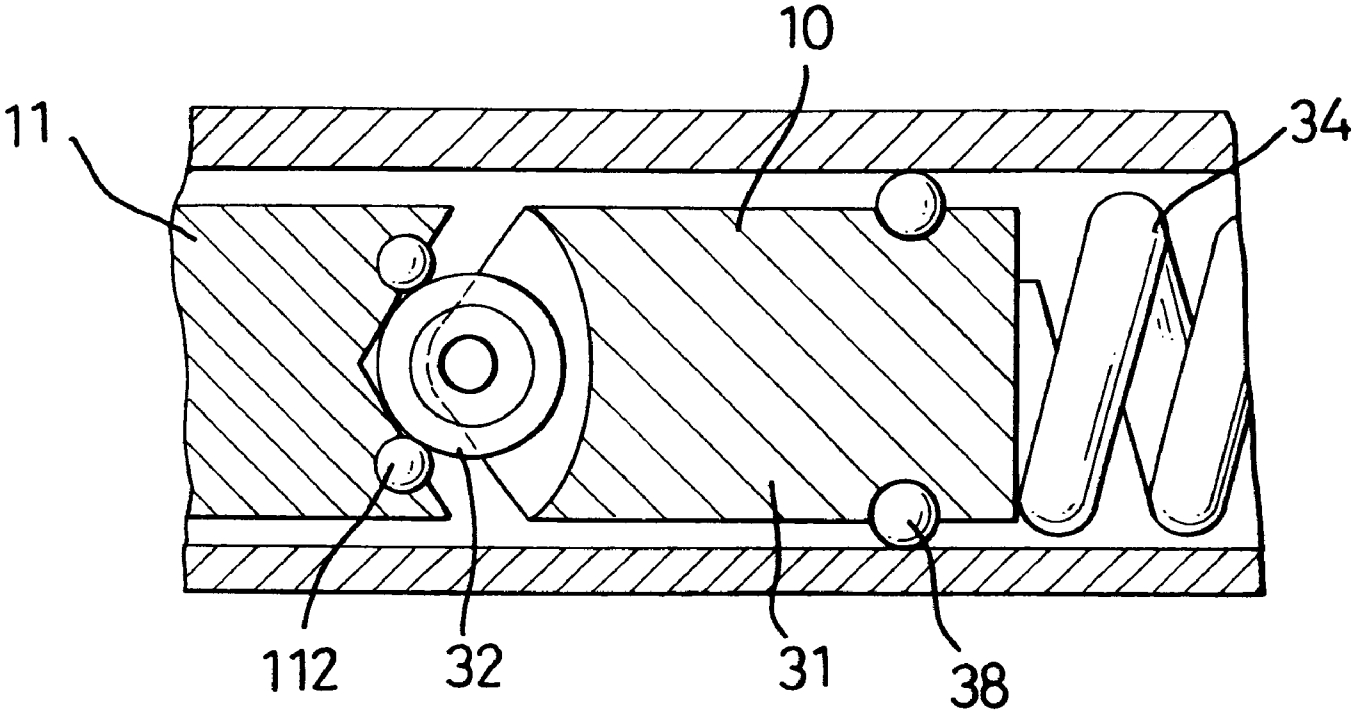
FIG. 5 is an enlarged top plan view in partial cross section of the torque-adjusting device in the torque wrench in FIG. 4.
Figure 6:
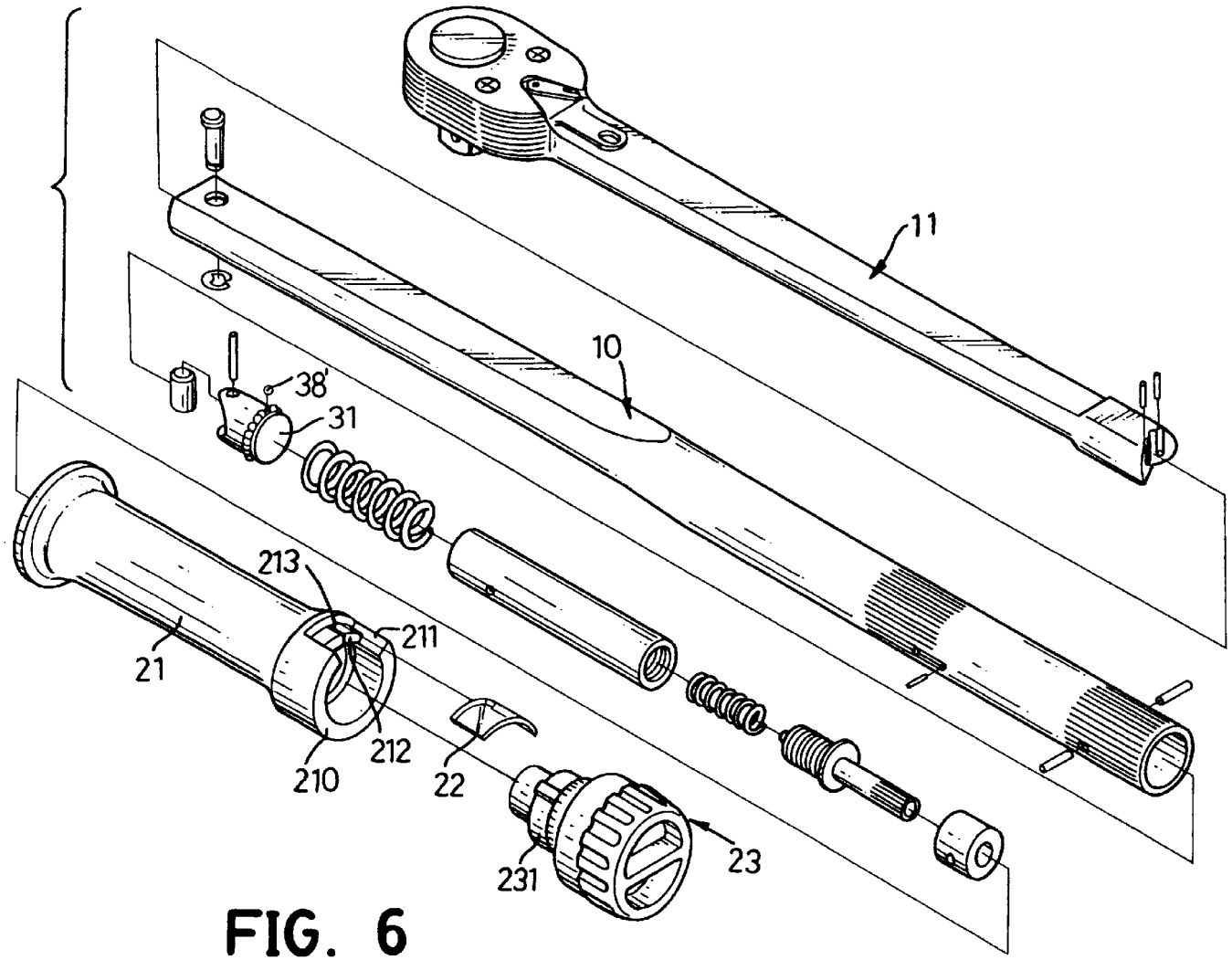
FIG. 6 is an exploded perspective view of a third embodiment of a torque wrench in accordance with the present invention.

With reference to FIGS. 3 to 5, multiple balls (38,38') are mounted around the outer periphery of the cylinder mount (31) and abut the inner surface of the shank (10). With the balls (38,38'), the cylinder mount (31) can be stably held in the shank (10), and the vibration of the cylinder mount (31) can be prevented.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A torque wrench for tightening fasteners, comprising:

a shank;

an arm inserted into a first end of the shank;

a torque-adjusting device received in the shank and connected to the arm for adjusting a torque provided by the arm to the fasteners, and the torque-adjusting device comprising:

two pins longitudinally mounted on an inserted end of the arm and parallel with each other;

a cylinder mount received in the shank;

a cylinder attached to the cylinder mount with a pivot and abutting the inserted end of the arm at a position between the two pins;

a first biasing member received in the shank and a first end abutting the cylinder mount;

a pushing sleeve moveably received in the shank and abutting a second end of the first biasing member, such that the first biasing member can provide a pushing force to the cylinder mount to press against the arm;

a second biasing member received in the pushing sleeve and having a first end abutting an inner surface of the pushing sleeve; and a pushing bar screwed into the pushing sleeve at an end of the sleeve far apart the cylinder mount and abutting a second end of the second biasing member;

a handle mounted around a second end of the shank and having a mouth formed on one end of the handle, and a window defined in a periphery of the mouth; and an adjusting knob rotatably attached to the second end of the shank and having a stepped protrusion formed on the adjusting knob, connected to the pushing bar of the torque-adjusting device and received in the mouth;

wherein a scale is formed on an outer periphery of the stepped protrusion and corresponds to the window on the handle; and an index line is formed on the handle and corresponds to the scale on the adjusting knob.

2. The torque wrench as claimed in claim 1 further comprising a collar securely received in the shank and mounted around one end of the pushing bar.

3. The torque wrench as claimed in claim 1, wherein a magnifier is secured in to cover the window to provide a magnifying effect to the scale.

4. The torque wrench as claimed in claim 1, further comprising:

multiple balls mounted around an outer periphery of the cylinder mount and abutting an inner surface of the shank to stably hold the cylinder mount in the shank.

5. A torque wrench for tightening fasteners, comprising:

a shank;

an arm inserted into a first end of the shank;

a torque-adjusting device received in the shank and connected to the arm for adjusting a torque provided by the arm to the fasteners;

a handle mounted around a second end of the shank and having a mouth formed on one end of the handle, and a window defined in a periphery of the mouth; and an adjusting knob rotatably attached to the second end of the shank and having a stepped protrusion formed on the adjusting knob, connected to the torque-adjusting device and received in the mouth;

wherein a scale is formed on an outer periphery of the stepped protrusion and corresponds to the window on the handle;

an index line is formed on the handle and corresponds to the scale on the adjusting knob;

wherein a notch is defined in the periphery of the mouth on the handle and corresponds to the scale on the stepped protrusion; and an extension extends from a bottom of the notch in a length shorter than a depth of the notch so as to define a window in the handle for the scale on the stepped protrusion to be shown from the window.

6. The torque wrench as claimed in claim 5, wherein the index line is formed on a top of the extension and corresponds to the scale on the stepped protrusion.

7. The torque wrench as claimed in claim 6, wherein a magnifier is secured in the notch to cover the window to provide a magnifying effect to the scale.

8. The torque wrench as claimed in claim 5, wherein the handle is made of a flexible material.

9. The torque wrench as claimed in claim 5, wherein a magnifier is secured in the notch to cover the window to provide a magnifying effect to the scale.

10. The torque wrench as claimed in claim 6, wherein the torque-adjusting device includes a cylinder mount received in the shank; and wherein the torque wrench further comprises multiple balls mounted around an outer periphery of the cylinder mount and abutting an inner surface of the shank to stably hold the cylinder mount in the shank.

* * * * *